US006052850A

United States Patent [19]

Salido et al.

[11] Patent Number: 6,052,850

[45] Date of Patent: Apr. 25, 2000

[54] HEAD SUPPORT DEVICE FOR INFANTS

[76] Inventors: Cynthia R. Salido; Rudolph E. Salido, both of 717 April Dr., Huntington Beach, Calif. 92648

[21] Appl. No.: 09/236,190

[22] Filed: Jan. 23, 1999

[51] Int. Cl.[7] ..... A47G 9/00

[52] U.S. Cl. ..... 5/644; 5/637; 5/655; 5/655.5

[58] Field of Search ..... 5/636, 637, 638, 5/644, 652, 652.1, 654, 655, 655.5

[56] References Cited

U.S. PATENT DOCUMENTS

| | | | |
|---|---|---|---|
| 3,848,281 | 11/1974 | Mathews | 5/636 |
| 4,243,754 | 1/1981 | Swan, Jr. | 5/909 X |
| 4,380,569 | 4/1983 | Shaw | 5/655.5 X |
| 4,456,642 | 6/1984 | Burgdorfer et al. | 5/655.5 X |
| 5,471,690 | 12/1995 | McNeil | 5/644 |
| 5,626,657 | 5/1997 | Pearce | 5/644 X |

*Primary Examiner*—Michael F. Trettel
*Attorney, Agent, or Firm*—Leonard Tachner

[57] ABSTRACT

A suitable support device for newborns including premature babies comprises a doughnut-shaped structure having a gel-filled GORE-TEX casing of about five to six inches outer diameter with a central aperture of about two to three inches in diameter. The structure provides an annular tube having about a 1 to 2 inch diameter. The tube is preferably circular in cross-section at the rear or head region and preferably flattened to provide a generally oval cross-section at the front or neck region. The case is filled with a cohesive gel mass such as silicone gel or silicone elastomers with sufficiently cross-linked polysiloxane networks to substantially retain a selected shape despite the force of a limited incident weight.

10 Claims, 2 Drawing Sheets

HEAD SUPPORT DEVICE FOR INFANTS

BACKGROUND OF THE INVENTION

1. Field of the Invention

The present invention relates generally to the field of neonatal care and more specifically to a head support device for newborns.

2. Prior Art

Newborn babies, especially those born premature, are preferably maintained in a supine position. In this position, a baby's airways are far less likely to become inadvertently obstructed. Moreover, the child's condition can be more readily observed when he or she is in a supine position. However, the baby's head and neck must be safely supported so that there is no undue stress to the neck and spine. Thus, it would be advantageous if there were a supporting device that would hold a baby's head straight and supported the baby's neck while the child rests in a supine position. Unfortunately, there does not appear to be any prior art devices suitable for such a purpose. While there are numerous prior art disclosures of supportive pillows, none appears suitable for providing an appropriate support for the head and neck of a newborn lying in a supine position wherein the neck must be adequately supported while the head is gently but firmly restrained from turning to either side. A search of the prior art had revealed the following relevant patents:

U.S. DES. Pat. No. 328,683 to Kalozdi
U.S. Pat. No. 4,197,604 to Nakamura
U.S. Pat. No. 4,236,264 to Britzman
U.S. Pat. No. 4,679,262 to Davis et al
U.S. Pat. No. 4,726,085 to Antonio
U.S. Pat. No. 4,731,890 to Roberts
U.S. Pat. No. 4,788,728 to Lake
U.S. Pat. No. 4,980,937 to Mason et al
U.S. Pat. No. 5,261,134 to Matthews
U.S. Pat. No. 5,519,906 to Fanto-Chan
U.S. Pat. No. 5,546,620 to Matthews
U.Ss Pat. No. 5,661,861 to Matthews Of the foregoing patents, the following which appear more pertinent, are summarized as follows:

U.S. Pat. No. 5,261,134 to Matthews is directed to an infant support pillow. As shown in FIG. 1, the support pillow 10 has a generally toroidal shape. The central, inner curve 14 defines a rounded, generally circular or elliptical well region 16. Well region 16 has a width W, as shown in FIG. 1, in the direction perpendicular to the central plane, of at least half the span across the width of an infant's torso, yet substantially less than such span, for example, less than ⅞ths of this span. As shown in FIG. 2, the central core 30 is a resilient, compression-resistant, hypo-allergenic material, such as polyester. It is encased in a lining 32, such as cotton or other pliant, conforming fabric. The polyester is firmly and tightly packed into lining 32, such that the core and lining together provide a self-supporting pillow body. The body of the support pillow is covered with a conforming removable exterior covering 34, also preferably of cotton.

FIG. 3 depicts an alternative embodiment of the pillow. A resilient, unitary central core of a rubber or polymeric foam 40, such as polyethylene foam, forms the body of the support pillow. It is covered with a form-fitted but relatively loosely draped exterior covering 42, preferably of cotton fabric. Various applications of the pillow are depicted in FIG. 4, views A–D. An infant may be comfortably placed on its stomach in line with the plane 2—2, as shown in FIG. 4A. FIG. 4B depicts the converse. An infant is placed on its stomach in line with the plane 2—2, as shown in FIG. 4A. FIG. 4B depicts the converse. An infant is placed along the plane 2—2 with his back to the well region 16.

U.S. Pat. No. 5,661,861 to Matthews is directed to torso supporting methods. The support pillow 10 includes a curved outer surface 12 which is rounded in both a longitudinal and a lateral direction. The support pillow 10 further includes a curved central inner surface 14 which defines a rounded, generally circular or elliptical well region 16. The pillow 10 includes a central core 30 which is constructed of a resilient, compression-resistant, hypo-allergenic material, such as a polyester filling. The central core 30 is encased in a lining 32, such as cotton or other pliant conforming fabric. As shown in FIG. 7, the support pillow 10 is placed around a person's neck, with the medial region 15 being at the back of the person's head and the ends 22, 24 being in front of the person's neck. The well region 16 is sufficiently sized so that the support pillow 10 will not choke or interfere with the breathing of the person. The support pillow 10 is placed around the person's neck by pulling the ends 22, 24 away from each other and sliding the ends 22, 24 around the neck. When placed around the neck, the support pillow 10 rests upon the person's shoulders so that when the person's head is tilted, the person's neck or head will rest against the support pillow 10 in the region of the open well 16.

U.S. Pat. No. 4,726,085 to Antonio is directed to a support device for infants. As shown in the Drawings, device 10 includes a self-supporting generally planar foam body or insert 12. Such body 12 is adapted for insertion into a cover 14 of a soft washable fabric having an upper surface 16 and a lower surface 18. The main forwardly disposed portion 20 of the cover 14 includes a slit 22 in the lower surface 18 through which the insert 12 may be positioned into a pocket 24. A generally U-shaped cut 26 extends into the body insert 12 from the rear edge 28 thereof. Such cut-out 26 as well as the similarly shaped cover 14 are adapted to receive the baby's neck, as shown in FIG. 5. The cover 14 further includes a pair of positioning flaps 30 which extend rearwardly from the forward cover portion 20.

U.S. Pat. No. 4,788,728 to Lake is directed to a contoured pillow with central aperture. As shown in the Drawings, the pillow body 2, 2', 2" is generally rectangular and has a top surface 6 and a bottom surface 8. An oblong hollow 30 is formed in the body 2, 2', 2" and opens onto the top surface 6. The hollow 30, the forward portion 10, and the rear portion 12, 12' are dimensioned in position to support the head and neck of a user in a proper manner and to prevent the pillow 2, 2' from exerting pressure on a lower portion of the user's face. FIG. 1 illustrates the support that the pillow 2 provides to a user lying in a supine position. FIG. 3 illustrates the use of the pillow 2 in a side position. FIGS. 10–15 illustrate the stages of the preferred method of fabrication of the pillow 2". The fabrication begins with a block of foam shaped like an ordinary pillow. The pillow body 2, 2' 2" may be made from any suitable material, such as high quality latex foam rubber.

U.S. Design Pat. No. 328,683 to Kalozdi is directed to a pillow assembly for babies or the like. As shown in FIGS. 1–7, the baby pillow includes a generally toroidal region for support of the baby's neck.

In examining the prior art for related disclosures, it is important to understand the special needs of support for an infant's head and neck. The head is about the size of a grapefruit and the neck muscles are under-developed and generally incapable of bearing the weight of the head which is disproportionately larger in newborns. Consequently, there must be virtually no freedom of movement of the head either up and down or side-to-side. Moreover, the support must be soft enough to bear against paper thin skin of premature babies without causing skin breakdown, pressure sores or topical distortion of the soft skull bone tissue underneath the skin of the head.

It will be seen that all of the prior art referred to above, discloses support devices which do not meet these needs. Such prior art devices are either too large, too soft, too hard, too flexible, do not adequately support the head and neck or permit too much freedom of movement and generally otherwise fail to meet the criteria for use with newborns.

SUMMARY OF THE INVENTION

The present invention is designed to satisfy the criteria for a suitable support device for newborns including premature babies as described above. A preferred embodiment of the invention comprises a doughnut-shaped structure having a gel-filled GORE-TEX casing of about five to six inches outer diameter with a central aperture of about two to three inches in diameter.

Thus, the structure provides an annular tube having about a 1 to 2 inch diameter. The tube is preferably circular in cross-section at the rear or head region and preferably flattened to provide a generally oval cross-section at the front or neck region.

The exterior case is preferably made of a water repellent fabric treated to be resistant to penetration of blood and other body fluids such as GORE surgical barrier fabric sold by W.L. Gore and Associates under the trademark GORE-TEX.

The case is filled with a cohesive gel mass such as silicone gel or silicone elastomers with sufficiently cross-linked polysiloxane networks to substantially retain a selected shape despite the force of limited incident weight. The tensile strength and tear resistance of the gel mass may be increased by the addition of amorphous silica pretreated with organosilicon compounds.

The resulting support device is very suitable for supporting the head and neck of a newborn in a supine position.

OBJECTS OF THE INVENTION

It is therefore a principal object of the present invention to provide a head support apparatus for newborns for limiting head movement from the supine position.

It is another object of the present invention to provide a head support device for newborn babies including premature babies wherein a pre-formed annulus cushions the neck region and holds the head upright without placing undue pressure on the baby's delicate skin.

It is yet another object of the invention to provide a doughnut-shaped, gel-filled head support device which prevents head movement of a newborn when the child is in a supine position.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
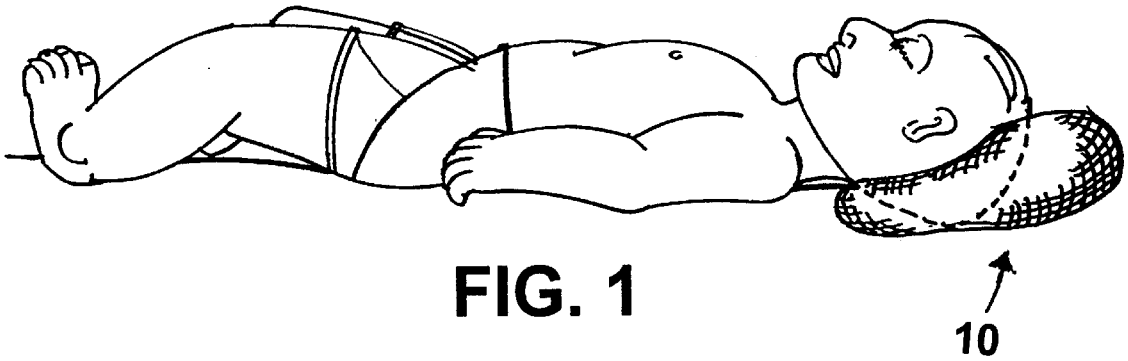
FIG. 1 is a side view of a baby in a supine position with the head support device shown in use.
Figure 2:
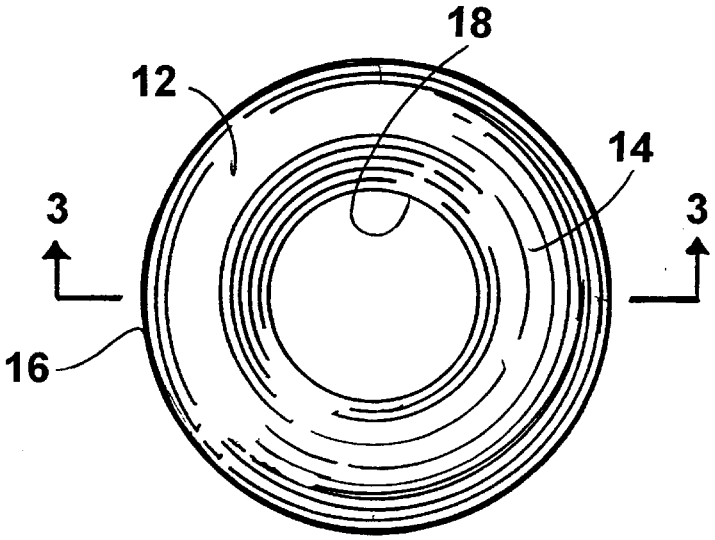
FIG. 2 is an elevational view of the head support device.
Figure 3:
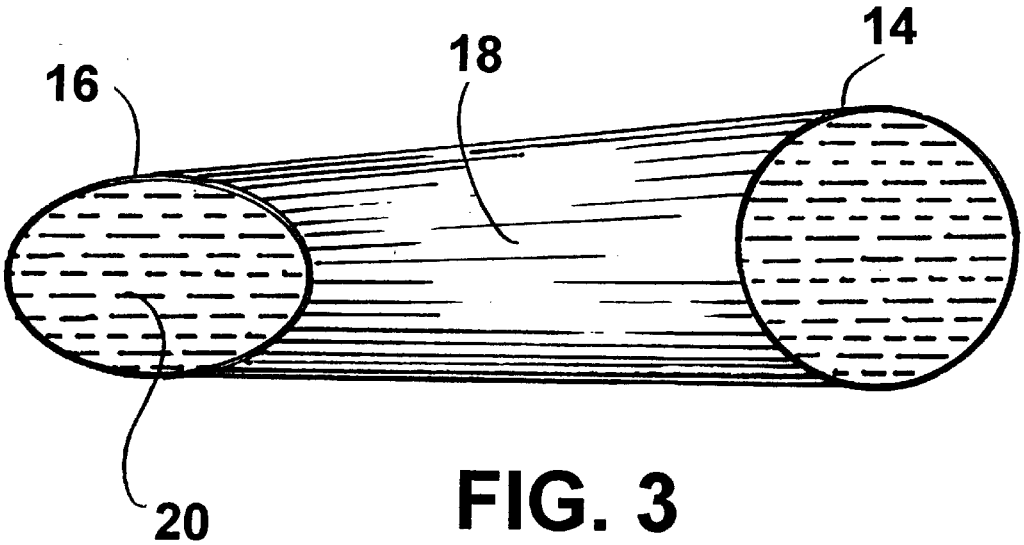
FIG. 3 is a side, cross-sectional view of the invention.
Figure 4:
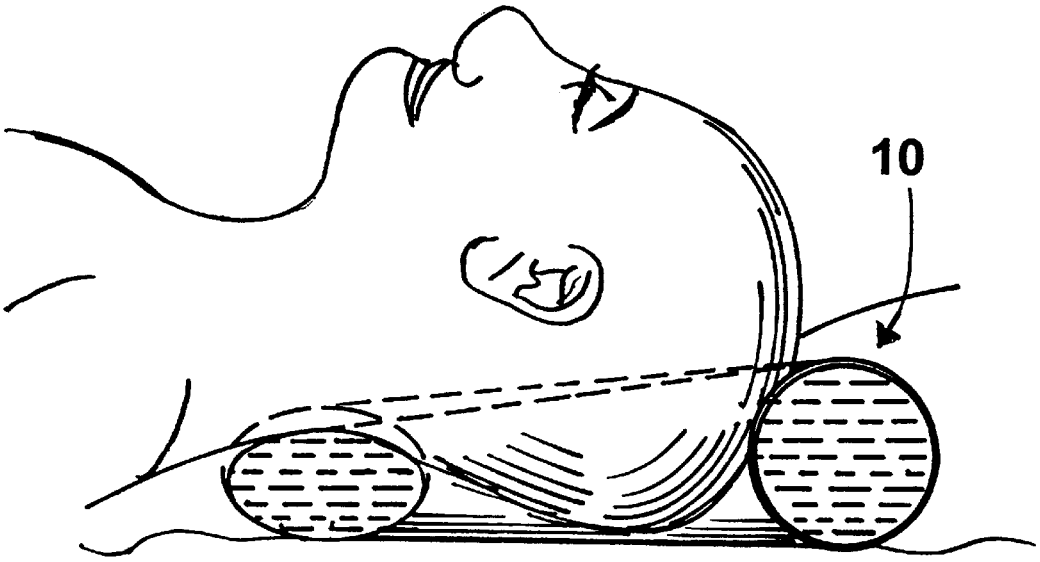
FIG. 4 is a side, cross-sectional view similar to FIG. 3, but illustrating the head and neck support function thereof.

Referring to the accompanying drawings it will be seen that a head support device 10, in accordance with the preferred embodiment of the invention, comprises a doughnut-shaped or annular case 12. Case 12 comprises a thicker head support region 14 and a thinner neck support region 16. Case 12 forms an aperture 18 through which the child's head projects as seen best in FIGS. 1 and 4.

Case 12 is preferably filled with a gel-like material 20. In the preferred embodiment shown herein, case 12 is made of a water repellent fabric treated to be resistant to penetration of blood and other body fluids such as GORE surgical barrier fabric sold by W.L. Gore and Associates under the trademark GORE-TEX. In the preferred embodiment, gel-like material 20 comprises a cohesive gel mass such as silicone gel or silicone elastomers with sufficiently cross-linked polysiloxane networks to substantially retain its shape despite the weight of the baby's head and neck.

It is contemplated herein that the head support device 10 would be made available in a plurality of different standard sizes to accommodate different head sizes. Moreover, the degree of compression of the device in response to the weight of the child's head and neck may be readily altered by varying the characteristics of the gel-like material. Thus, for example, the tensile strength and tear resistance of the gel may be increased by the addition of amorphous silica pre-treated with organosilicon compounds. Accordingly, the precise dimensions, shape and "hardness" of the support device are readily selectable for different requirements. Of course, it will be understood that the case 12, as well as the material contained within the case, may be made of other suitable alternatives. Thus for example, case 12 may be made of a gauze-like material and it may be used in conjunction with a Styrofoam-filled interior instead of a gel-like material. In either case, it is contemplated that each support device would be discarded after some limited period of use for one child, thereby reducing the risk of spreading disease or infection.

Having thus described a preferred embodiment of the invention for purposes of illustrating the inventive concepts thereof, it being understood that the scope hereof is not necessarily limited to that particular embodiment, what is claimed is:

1. A head and neck support apparatus for newborns lying in a supine position; the apparatus comprising:

a doughnut-shaped case having a neck support region and a head support region;

a gel-like material substantially filling said case and being shaped to provide a partially flattened neck region;

said head support region having a substantially circular-shaped cross-section and said neck support region having a substantially oval-shaped cross-section even without any weight on said aapparatus.

2. The apparatus recited in claim 1 wherein said doughnut-shaped case comprises a central aperture having a diameter which is about two to three inches.

3. The apparatus recited in claim 1 wherein said case comprises a water repellent fabric.

4. The apparatus recited in claim 1 wherein said gel-like material comprises a silicone compound.

5. The apparatus recited in claim 1 wherein said case comprises a substantially circular cross-section at said head support region and a substantially oval cross-section at said neck support region.

6. A head and neck support apparatus for newborns lying in a supine position; the apparatus comprising:

an annulus having an outer diameter of about five to six inches, an inner diameter of about two to three inches and a cross-sectional dimension of about one to two inches; the annulus being partially compressible and being flatter at one side than the opposite side even without any weight on said apparatus.

7. The apparatus recited in claim 6 wherein said annulus comprises a case filled with a partially compressible material.

8. The apparatus recited in claim 7 wherein said case comprises a water repellent fabric.

9. The apparatus recited in claim 7 wherein said partially compressible material comprises a gel.

10. The apparatus recited in claim 9 wherein said gel comprises a silicone compound.

* * * * *